United States Patent [19]

Gillett

[11] 4,244,246

[45] Jan. 13, 1981

[54] WRENCH WITH AUTOMATIC FEED MECHANISM

[76] Inventor: Dennis L. Gillett, 21440 Shady La., Los Gatos, Calif. 95030

[21] Appl. No.: 7,568

[22] Filed: Jan. 29, 1979

[51] Int. Cl.[3] ..... B25B 13/02

[52] U.S. Cl. ..... 81/125; 81/177 M

[58] Field of Search ..... 81/125, 177 M; 145/50 D, 62, 63

[56] References Cited

U.S. PATENT DOCUMENTS

| | | | |
|---|---|---|---|
| 2,993,397 | 7/1961 | Albertson et al. | 81/125 |
| 3,416,395 | 12/1968 | Hanson | 81/125 |

FOREIGN PATENT DOCUMENTS

| | | | |
|---|---|---|---|
| 302023 | 10/1932 | Italy | 81/125 |

*Primary Examiner*—James G. Smith

*Attorney, Agent, or Firm*—Linval B. Castle; Paul Hickman

[57] ABSTRACT

A hand-held wrench having a mechanism for automatically feeding a fastener into its driving tip. The wrench includes a hollow handle portion enclosing a spring-loaded shaft which biases a number of fasteners disposed within a driver portion towards the driving tip of the wrench. A detent mechanism is provided to hold the fasteners at the driving tip until the fastener driving operation is completed.

5 Claims, 4 Drawing Figures

WRENCH WITH AUTOMATIC FEED MECHANISM

BACKGROUND OF THE INVENTION

1. Field of the Invention

This invention relates generally to hand tools and more particularly to wrenches having automatic feed mechanisms to supply fasteners to their driving tip.

2. Description of the Prior Art

One of the most time consuming operations performed by assembly line personnel is the driving of fasteners. For example, to attach one subassembly to another it may be necessary to individually place a washer and then a lock washer over a number of threaded studs or bolts and then to thread and tighten a nut upon each one of the studs or bolts. Efficiency studies have indicated that, on the average, even an experienced assembler will require approximately thirty seconds to put a washer, lock washer and to fasten a nut upon a single stud. It may well be appreciated that this is a time consuming operation, and for example, should an assembly include twenty studs, the time required to fit a washer, lock washer and nut on all of the studs would be approximately ten minutes. This becomes quite expensive to the manufacturer due to the high cost of labor.

In order to speed up the process of driving fasteners, a number of prior art devices have been developed which automatically feed a fastener to the driving tip of a wrench. Such prior art devices, however, suffer from the disadvantage of being mechanically complex and relatively expensive. They further are not generally hand tools and usually require some type of external power source.

A further disadvantage of prior art wrenches having automatic feed mechanisms is that washers and lock washers, if they are needed, must still be manually placed upon a stud.

SUMMARY OF THE INVENTION

It is an object of this invention to provide a wrench with automatic feed mechanism that is hand operated, portable, and mechanically non-complex.

A further object of this invention is to provide a wrench with automatic feed mechansim which further can feed a washer and lock washer onto a stud prior to threading a nut onto that stud.

It is yet a further object of this invention to provide a wrench with automatic feed mechanism that can be used to quickly drive great numbers, varieties and types of fasteners.

Briefly, the invention comprises an elongated body formed by the end-to-end attachment of a handle portion and a driver portion. The handle portion is hollowed and the driver portion is provided with an elongated hexagonal bore or broach hole that extends between its two ends. The broach hole defines a driving tip near the free end of the driver portion that is configured so as to be engageable with a suitable fastener. A fastener magazine, which encloses a number of individual fasteners, is disposed within the broach hole so that the fasteners are in juxtaposition with the driving tip. A spring-loaded shaft is partially disposed within the hollow handle portion of the wrench and extends into the broach hole of the driver portion so as to bias the fasteners towards the driving tip. A number of detents are provided near the driving tip to counteract the biasing force of the spring-loaded shaft and to prevent the premature release of the fasteners.

In use, the assembler grasps the handle portion of the wrench, turns it until the fastener is tightened onto an assembly stud, and then removes the wrench from the stud so that the fastener is pulled past the detents. The spring-loaded shaft then forces the next fastener to move forwardly until stopped by the detents.

An advantage of this invention is that the automatic feed mechanism of the wrench allows fasteners to be driven extremely rapidly.

A further advantage of this invention is that the feed mechanism is mechanically uncomplicated and requires no external power source to operate.

Yet another advantage of this invention is that the handle portion and driver portions are separable so that a number of driver portions could be fitted onto the end of a handle portion in order to drive different sizes and types of fasteners.

These and other objects and advantages of the present invention will no doubt become apparent upon a reading of the following detailed description as accompanied by the several figures of the drawing.

DETAILED DESCRIPTION OF A PREFERRED EMBODIMENT

Figure 1:
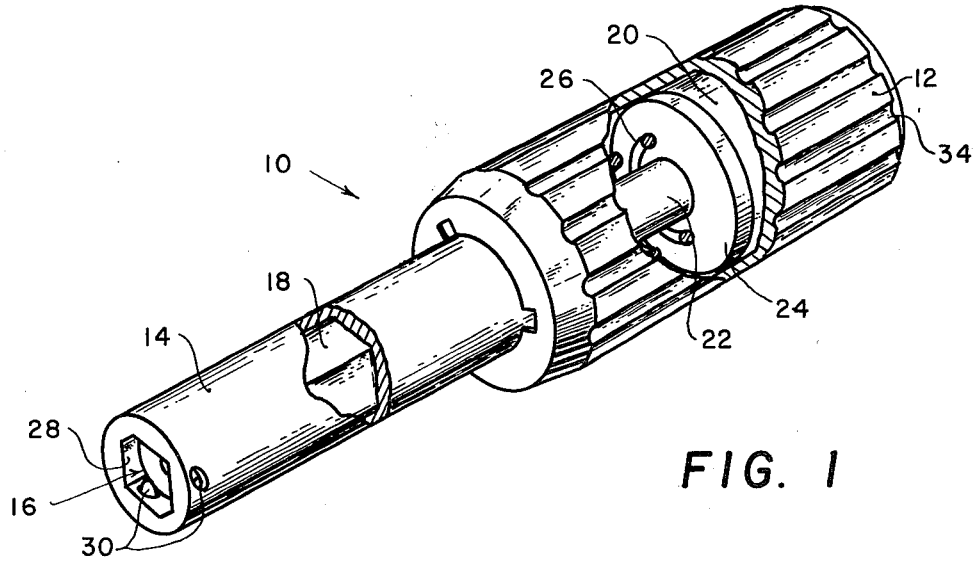
FIG. 1 is a partially broken perspective view of a wrench with automatic feed mechanism in accordance with the present invention.

Referring to FIG. 1, a wrench with automatic feed mechanism in accordance with the present invention includes an elongated body member 10 having a handle portion 12 and a driver portion 14 coaxially attached together. Handle portion 12 is substantially hollow and is open at the end which attaches to driver portion 14 and is closed at the other end. Driver portion 14 is provided with an elongated, bore or axial broach hole 16 which extends fully between its two ends. As seen here, broach hole 16 is preferably hexagonal in cross-section so as to be able to drive a hexagonal fastener.

Disposed within broach hole 16 is a magazine 18 which encloses a number of fasteners. A spring-loaded feed mechanism 20 including an elongated shaft 22, a shaft head 24, and a tension spring 26, are disposed within hollow handle portion 12 so that the free end of shaft 22 abuts the fasteners within magazine 18 and biases those fasteners towards the end of the broach hole which defines the driving tip 28 of the wrench. A number of detent members 30 extending through the wall of the driving tip 28 counter the biasing force of feed mechanism 20 and prevent the premature ejection of the fasteners from the driver portion.

Figure 2:
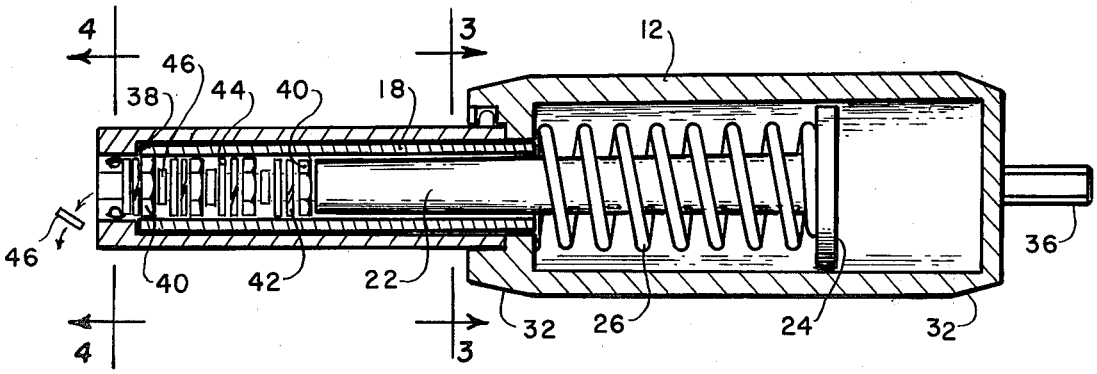
FIG. 2 is a cross-sectional view of the wrench shown in FIG. 1.

Referring additionally to the cross-sectional view of FIG. 2, handle portion 12 can be seen to be a substantially cylindrical member having beveled ends 32 and is provided with a plurality of grip enhancing grooves 34. Tension spring 26 is attached at a first end to an internal wall of the hollow handle portion and is firmly attached at its other end to shaft head 24. The shaft head has a cross-section providing a close, but non-binding, fit within the hollow handle portion and acts as a guide to keep elongated shaft 22 centrally aligned within the hollow handle portion and magazine 18. An attachment nub 36 may be provided for powered operation of the wrench, as will be discussed subsequently.

As seen most clearly in FIG. 2, the length of broach hole defining the driving tip 28 is of a smaller maximum diameter than the diameter of the remainder of the broach hole so as to form a step 38 against which the leading end of magazine 18 can abut. In this figure, magazine 18 can be seen to be a long, hollow tube of hexagonal cross-section into which a number of fasteners (nuts) 40 are placed. Separating fasteners 40 are a number of lock washers 42, washers 44 and spacers 46.

Figure 3:
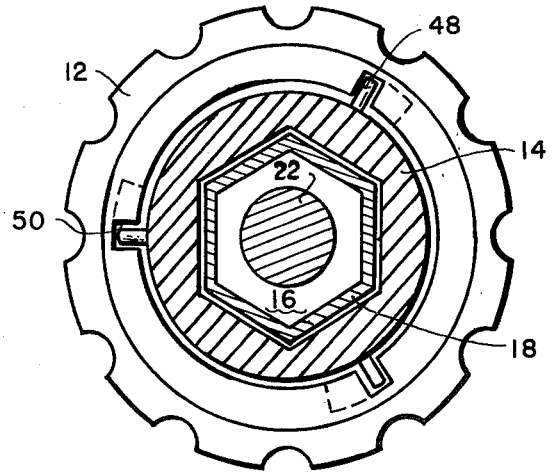
FIG. 3 is a cross-sectional view taken along line 3—3 of FIG. 2.

Referring additionally to the cross-sectional view of FIG. 3, it may be seen that driver portion 14 is preferably attached to handle portion 12 with a bayonet-type fastening including a number of pins 48 radially attached to the driver portion which engage a corresponding number of slots 50 which spiral into the handle portion. As the driver portion is rotated in a clockwise direction, pins 48 will wedge within the spiraling slots 50 to effect a firm connection between portions 12 and 14. When a user wishes to remove portion 14 from the handle portion, it is rotated in a counterclockwise direction and then the pins are pulled from the slots.

As best seen in FIG. 3, magazine 18 closely but slidably fits within broach hole 16. Shaft 22 is centrally aligned within the magazine, as discussed earlier. Preferably, magazine 18 is constructed from a material that lends itself to mass production, such as plastic or reinforced pulp products. Also, the magazine is preferably pre-loaded at the factory with fasteners for the convenience of the ultimate consumer.

Figure 4:
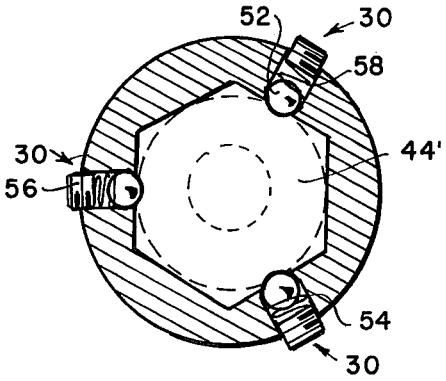
FIG. 4 is a cross-sectional view taken along line 4—4 of FIG. 2.

Referring now to FIG. 4, the detent members 30 may be described in greater detail. In this embodiment, the detent members consist of three bearings 52 disposed within radially formed bores 54 which open upon broach hole 16 at the driving tip. The opening of the bores 54 into the driving tip 28 of the broach hole is of a slightly smaller diameter than the diameter of the bearings 52 to thereby prevent loss of the bearings. The bores are threaded for engagement with a number of set screws 56 which vary the pressure exerted by a number of springs 58 upon the bearings 52. A washer is shown in phantom at 44' to indicate how the detent members can prevent the passage of fasteners. The force required to pull the washer through the broach hole past bearings 52 is adjustable by means of the set screws 56.

In operation, a driver portion 14 is selected which contains a magazine having the correct type of fasteners. For example, the fasteners could be arranged as illustrated in FIG. 2 or they could be arranged differently depending upon specific applications. Furthermore, driver portions could be selected that have fasteners other than nuts loaded within their magazine, such as hexagonal headed bolts.

After selecting a driver portion, the handle and driver portions are unified. A user than grasps the wrench by handle portion 12 and inserts the driving tip of the wrench over the stud or bolt onto which the nut is to be threaded. The shaft of the stud will go through the holes of the washers until the threaded hole of the nut is encountered. The wrench is then turned by hand until the nut is securely fastened upon the stud. Spacers 46 prevent more than one fastener from being attached to a stud at a time. The wrench is then pulled from the stud with sufficient force so that the two washers and the nut are pulled past the detent members 30. Spacers 46 are of a small enough diameter to simply fall out of broach hole 16 after the nut and washers are removed. Of course, if the user is careful to only thread onto one nut at a time, the spacers may be dispensed with.

For automatic operation, attachment nub 36 would be held within the chuck of a power rotary tool, such as an electric or pneumatic drill. The wrench would then be positioned over a stud as previously described. The rotary power tool would then be turned on, threading the nut onto the stud and simultaneously forcing the fasteners and shaft 22 towards the hollow handle portion against the biasing force of tension spring 26. After the nut is securely tightened, the tool is removed from the stud. The feed mechanism then pushes the fasteners back up to the detent members so that a new fastener assembly is again correctly positioned for attachment to a stud.

It is contemplated that various alterations and modifications of the present invention will become apparent upon a reading of the preceding detailed description. For instance, the detent members described could be replaced with a leaf spring type detent member with little or no effect upon the function of the wrench. Furthermore, other means of biasing the fasteners towards the driving tip of the wrench are contemplated, such as placing a compression spring between the shaft head and the end of the handle portion.

It is therefore intended that the following appended claims be interpreted as including all such alterations and modifications as fall within the true spirit and scope of the present invention.

What is claimed is:

1. A wrench having means for dispensing fasteners from a storage magazine removably contained within the wrench into the driving tip of said wrench, said wrench comprising:

a hollow tubular handle having an axial opening in the first end thereof;

a driver portion having a first end removably coupled to the first end of said handle, said driver portion having an axial bore throughout the length thereof and in open communication with said axial opening in the first end of said handle, said axial bore having a cross-section corresponding to the external cross-section of a desired storage magazine of fasteners;

a driving tip formed at the second end of said driver portion, said driving tip having a driving bore coaxial with the bore of said driver portion and in open communication therewith, said driving bore having a cross-section corresponding to the cross-section of fasteners within said desired storage magazine, the interface between the bore of said driver portion and said driving bore being a step for preventing the removal of said desired storage magazine through said driving bore; and feeding means within said hollow handle and extending into said axial bore of said driver portion for urging the contents of said bore of said driver portion toward said driving tip.

2. The wrench claimed in claim 1 further including spring-biased detent members within the wall of said driving tip and extending into said driving bore for inhibiting the free passage of fasteners through said driving bore.

3. The wrench claimed in claim 2 wherein said feeding means includes an elongated shaft within said hollow handle and coaxial therewith, said shaft being movable through said axial opening and into said axial bore of said driver portion; and a spring within said hollow handle and coupled to said elongated shaft, said spring urging said shaft into said axial bore toward said driving tip.

4. The wrench claimed in claim 3 further including a shaft head coupled to the end of said elongated shaft within said hollow handle and proximate the second end of said handle, said shaft head having a cross-section providing a slidable fit within said handle for maintaining axial alignment of said elongated shaft during movement thereof through said hollow handle.

5. The wrench claimed in claim 4 further including attachment means connected to the exterior surface of said second end of said hollow handle and coaxial therewith for coupling said wrench to the chuck of an external source of rotary power.

* * * * *